US012152404B2

(12) United States Patent
Thompson

(10) Patent No.: US 12,152,404 B2
(45) Date of Patent: Nov. 26, 2024

(54) SYSTEMS AND METHODS FOR AN ILLUMINATING BUBBLER HOUSING

(71) Applicant: Steven E. Thompson, Oldsmar, FL (US)

(72) Inventor: Steven E. Thompson, Oldsmar, FL (US)

( * ) Notice: Subject to any disclaimer, the term of this patent is extended or adjusted under 35 U.S.C. 154(b) by 266 days.

(21) Appl. No.: 18/052,623

(22) Filed: Nov. 4, 2022

(65) Prior Publication Data

US 2024/0151056 A1 May 9, 2024

(51) Int. Cl.
*E04H 4/12* (2006.01)
*E04H 4/14* (2006.01)

(52) U.S. Cl.
CPC ..... *E04H 4/12* (2013.01); *E04H 4/148* (2013.01)

(58) Field of Classification Search
CPC .... B05B 17/08–085; E04H 4/12–1236; E04H 4/1272; F21S 8/00; F21V 15/00; F21V 33/00
See application file for complete search history.

(56) References Cited

U.S. PATENT DOCUMENTS

| | | | | |
|---|---|---|---|---|
| 1,968,072 | A * | 7/1934 | Creighton | F21S 8/00 362/267 |
| 3,962,675 | A * | 6/1976 | Rowley | F21S 8/00 362/101 |
| 5,207,499 | A * | 5/1993 | Vajda | F21V 31/00 239/18 |
| 5,217,292 | A * | 6/1993 | Chalberg | A61H 33/6073 362/101 |
| 6,393,192 | B1 * | 5/2002 | Koren | G02B 6/0008 239/18 |
| 6,398,397 | B1 * | 6/2002 | Koren | G02B 6/0008 362/101 |
| 10,221,583 | B1 * | 3/2019 | Elder | F21V 31/005 |

* cited by examiner

*Primary Examiner* — David P Angwin
*Assistant Examiner* — Nicholas A Ros

(57) ABSTRACT

A pool return fitting having a housing with a first chamber and second chamber. The second chamber is retained within the first chamber. The first chamber has a first pipe connection configured to receive a fluid. The first chamber has a first opening bordering a third chamber of an integrally formed support structure. The second chamber has a second pipe connection configured to receive a conduit. The second chamber has a second opening configured to retain a submersible light fixture. A transparent lens is connected to the integrally formed support structure and has opening. Fluid flows from the first opening of first chamber into a third chamber of the integrally formed support structure, over a lens of the submersible light fixture retained by the second chamber, and through an opening of the transparent lens to be expelled from the third chamber into the surrounding fluid external of the housing.

20 Claims, 7 Drawing Sheets

SYSTEMS AND METHODS FOR AN ILLUMINATING BUBBLER HOUSING

BACKGROUND OF THE INVENTION

1. Field of the Invention

This invention relates, generally, to a wet niche fixture and, more particularly, to systems and methods for an illuminating bubbler housing.

2. Background Art

Generally described, a pool return fitting can be utilized to distribute pool chemicals throughout a pool, to push water around a pool, and/or to create a fountain-like water movement. In common application, a pool return fitting is combined in a side-by-side orientation with a submersible light fixture during the process of intaking the water and expelling the water. In such embodiments, existing pool return fittings are too bulky in size, which may be too costly during the manufacturing process and too bulky for affordable shipping and available shelving space in retail. It would be more desirable for a more compact housing for an illuminating pool return fitting.

Currently, many illuminating pool return fittings typically having the submersible light fixture being obstructed by come components of the pool return fitting. As a result, many of these existing illuminating pool return fittings have an excessive overall height which positions the submersible light fixture of the illuminating pool return fitting in an inaccessible location. A problem arises during installation and servicing of the pool return fitting because it is often difficult and/or impossible to access the submersible light fixture without specialized tools and equipment. Thus, there is a need for an illuminating pool return fitting that efficiently orients a submersible light fixture and the bubbler mechanism in a smaller package for easier installation and enhances the visual esthetics when installed on a surface of a pool and/or spa.

However, in view of the prior art considered as a whole at the time the present invention was made; it was not obvious to those of ordinary skill in the pertinent art how the identified needs could be fulfilled.

SUMMARY OF THE INVENTION

The long-standing but heretofore unfulfilled need for a pool return fitting having a housing with a first chamber and a second chamber. The second chamber is retained within the first chamber. The first chamber has a first pipe connection is configured to receive a fluid. The first chamber has a first opening bordering an integrally formed support structure. The second chamber has a second pipe connection configured to receive an electrical cord. The second chamber has a second opening configured to retain a submersible light fixture. A transparent lens has at least one opening. The transparent lens is configured to overlay at least a portion of an end of the first chamber and an end of the second chamber. The second opening of the first chamber is configured to expel a fluid from the first chamber of the housing over a lens of the submersible light fixture and through an opening of the transparent lens to the surrounding fluid and which also includes improvements that overcome the limitations of prior pool return fittings, is now met by a new, useful, and non-obvious invention.

In a first embodiment, the novel pool return fitting has a housing having a first chamber and a second chamber. It is within the scope of this invention for a pool to be anything that holds a fluid and/or a substance, such as water. A pool may include, but not be limited to, a pool, a spa, a splash pad, and/or a fountain. The second chamber is retained within the first chamber. The first chamber has a first pipe connection. It is within the scope of this invention for a pipe connection to include, but not be limited to, a threaded, a snug fit, and or an adhered connection of the housing to a pipe. The first pipe connection of the first chamber is configured to receive a fluid and/or a substance, such as water. It is within the scope of this invention for the first pipe connection to be located on any surface of the housing, including, but not limited to, a side wall and/or the bottom of the housing. The first chamber has a first opening bordering an integrally formed support structure. The second chamber has a second pipe connection. The second chamber has an inner wall surface and an outer wall surface. The second pipe connection of the second chamber is configured to receive an electrical cord of the submersible light fixture and/or a fiber optic cable.

It is within the scope of this invention for the first chamber to retain the second chamber when the first pipe connection and the second pipe connection are positioned perpendicular to each other when the first pipe connection is connected to a side wall surface of the housing and the second pipe connection is connected to the rear of the housing. It is within the scope of this invention for the first chamber to retain the second chamber when the first pipe connection and the second pipe connection are positioned next to each other at the rear of the housing and/or when the first pipe connection is connected to the bottom of the housing and the second pipe connection is connected to the bottom of the housing.

The second chamber has a second opening. The second opening of the second chamber is configured to retain a submersible light fixture. It is within the scope of this invention for a submersible light fixture to include, but not be limited to, a light emitting diode, a light bulb, and/or fiber optics. At least a portion of the submersible light fixture is removably connected to at least a portion of an inner wall surface of the second chamber. It is within the scope of this invention for the submersible light fixture to be snug fit or threaded into the second chamber. This threaded and/or snug fit of the submersible light fixture within the second chamber creates a water resistant seal capable of preventing fluid from entering the second chamber.

It is an important aspect of this invention for a fluid, such as water, to not circulate through the second chamber. If water circulates through the second chamber, the submersible light fixture electrical components may become exposed to excessive water and become damaged. To maintain the water resistant feature, so that water does not flow through the second chamber, the housing has a unique structural configuration which allows the water to flow into the first pipe connection and flow into the first chamber. The second chamber is retained by the first chamber. The second chamber traverses the length of the first chamber. The first opening of said first chamber is configured to expel the fluid into a third chamber, whereby, the fluid is flowing from the first pipe connection of the housing, and then the fluid is flowing in a channel formed between the outer wall surface of the second chamber and the inner wall surface of the first chamber. The fluid is then expelled from the first chamber of the housing into a third chamber located within at least a portion of the integrally formed support structure, whereby, said fluid flows over a lens of the submersible light fixture and through said at least one opening of the transparent lens to the surrounding fluid external of the housing.

Although water may enter the second chamber during use, the novel pool return fitting is not configured for water to flow through and/or circulate through the second chamber. At least a portion of the third chamber within the integrally formed support structure is covered by the transparent lens. The novel pool return fitting is configured for the third chamber of the integrally formed support structure to receive water from the first chamber prior to the water flowing through the opening of the transparent lens. Fluid flows from the first opening of first chamber into a third chamber of the integrally formed support structure, over a lens of the submersible light fixture retained by the second chamber, and through an opening of the transparent lens to be expelled from the third chamber into the surrounding fluid external of the housing.

The novel pool return fitting has a housing with a transparent lens. The transparent lens has at least one opening. An opening of the lens may be configured receive a fastener and/or to expel fluid from the first chamber into surrounding water. The transparent lens is configured to overlay at least a portion of an end of the first chamber and an end of the second chamber. It is within the scope of this invention for the transparent lens to be configured to overlay the integrally formed support structure. The transparent lens is oriented substantially parallel with the lens of the submersible light fixture when the submersible light fixture is retained by the second chamber of the housing. The transparent lens is suspended over the lens of the submersible light fixture by at least one retaining member of the integrally formed support structure. The transparent lens is positioned to overlay the third chamber of the integrally formed support structure. The second opening of the first chamber is configured to expel fluid from the first chamber of the housing, into the third chamber, over a lens of the submersible light fixture, and through at least one opening of the transparent lens to the surrounding fluid. It is within the scope of this invention for at least one opening of the transparent lens to be substantially centrally located on the transparent lens.

In an alternate embodiment, the novel pool return fitting may have an inner wall surface of the second chamber having at least one protrusion. At least one protrusion is configured to connect to at least a portion of the submersible light fixture to retain the submersible light fixture in place within the second chamber.

In an alternate embodiment, the novel pool return fitting may have an inner wall surface of the second chamber having a threaded portion. The threaded portion of the second chamber is configured to interconnect with at least a portion of a corresponding threaded portion of a submersible light fixture.

In yet another alternate embodiment, the novel pool return fitting may have an integrally formed support structure having a stepped portion configured to retain the transparent lens within the housing. The integrally formed support structure has at least one retaining member connected to an inner wall surface of third chamber of the housing. At least one retaining member extends from an inner wall surface of the third chamber of the housing protruding into and/or over at least a portion of the first chamber.

In another alternate embodiment, the novel pool return fitting may have a transparent lens having at least one bore configured to receive a fastener, such as a screw. At least one retaining member has an opening configured to receive the fastener. At least one bore of the transparent lens is aligned with the opening of at least one retaining member when the fastener is received by at least one bore of the transparent lens and the opening of at least one retaining member, thereby, securing the transparent lens to the integrally formed support structure.

In an alternate embodiment, the novel pool return fitting may have a sealing member. It is within the scope of this invention for the sealing member to be an O-ring. The sealing member may be located between at least a portion of the fastener and the transparent lens. The sealing member may be located between at least a portion of the fastener and the removable cover. The sealing member may be located between said removable cover and the removable support structure.

In an alternate embodiment, the novel pool return fitting may have an integrally formed support structure retaining a removable support structure. The removable support structure is an extension top. The removable support structure having a stepped portion location an inner wall surface of the removable support structure. The removable support structure has the same retaining member features as the integrally formed support structure. The removable support structure is configured to retain a removable cover. The removable support structure has at least one retaining member connected to an inner wall surface of the removable support structure.

In an alternate embodiment, the novel pool return fitting may have a removable cover. The removable cover is configured to cover the removable support structure and/or to cover the integrally formed support structure. The removable cover has at least one bore configured to receive a fastener. At least one retaining member has an opening configured to receive a fastener. At least one bore of the removable cover is aligned with an opening of at least one retaining member when the fastener is received by at least one bore of the removable cover and the opening of at least one retaining member, thereby, securing the removable cover to the removable support structure. It is within the scope of this invention for the removable cover to be positioned to cover the transparent lens and/or an opening on an end of the housing.

In a preferred embodiment, the novel pool return fitting is used in the following method. Step 1, providing the novel pool return fitting having the temporary cover installed. It is within the scope of this invention for the novel pool return fitting to be referred to as a light emitting diode (LED) bubbler. The removable cover has openings that align with openings of the retaining members of the integrally formed support structure. A fastener, such as a screw, is received by the openings of the removable cover and by the openings of the retaining members. A user should not overtighten the screws during installation. Ensure the surface of the housing and all of the O-rings are clean and free of debris. The seat O-ring positioned between the cover and an end of the housing as well as the fastener O-rings positioned between a fastener and the cover, ensures an efficient seal for pressure testing.

Step 2 includes determining the elevations of all important future points in the pool. Calculating, using these points, the exact location and elevation at which the novel pool return fitting will need to be set at to function at optimal efficiency.

Step 3 includes trenching out any pathway required to run the electrical conduit for receiving the fiber optic cable and/or electrical cord of a submersible light fixture. It is within the scope of this invention for the fiber optic cable to just be a cable and not have a light fixture. Trench out the pathway required to run the water feed pipe to the novel pool return fitting.

Step 4 includes adhering with an adhesive including, but not limited to, glue, the conduit sweep and conduit into the conduit port at the bottom of the unit and direct the conduit as desired. Backfill the conduit as needed and then adhere in the water feed to the water port of the unit and direct the water feed pipe as desired. Use a cleaner and a primer to complete this step.

Once the conduit and water feed pipe are completed as desired, the lines are ready for pressure testing. Step 5 includes the step of connecting each end of the conduit pipe and water feed pipe to a manifold or to be capped as needed. Pressure test according to local requirements.

Step 6 describes placing concrete around the novel pool return fitting as desired, making sure to leave a swailed ring around the top of the housing. In a preferred embodiment, the concrete may be punished at an elevation of including, but not limited to, approximately ⅜" below the top of the novel pool return fitting, and the swailed ring should be below.

At Step 7, after the concrete has cured, hydraulic cement is applied around the perimeter of the top of the novel pool return fitting. Infilling the swailed area while still using including, but not limited to, approximately ⅜" below the top of the novel pool return fitting to allow for a pool surface to be applied. If the concrete pour level is too high, adhere in the optional extension ring or removable support structure to raise the overall novel pool return fitting's height.

Step 8 includes the novel pool return fitting receiving the pool surface application. The surface should be flush to the top of the novel pool return fitting. Next, at Step 9 the temporary removable cover is removed from the novel pool return fitting. Installing the light fixture as directed by the light fixture's manufacturer's recommendations. At Step 10, installing the clear cover with screws. If a tighter stream of water is desired, press the lens-reducer into the bottom side of the clear cover. The return reducer has an opening having a smaller diameter than the opening of the lens that expels water from the third chamber into surrounding water. The return reducer is configured to connect to an opening of the transparent lens.

In a preferred embodiment, an underwater wet niche housing is configured to retain a lighting fixture integrated with a fluid source to create an illuminated water structure in a shallow location of a swimming pool, for example. An outer housing with a side port fluid connection encapsulates an inner chamber with a conduit connection at its base that retains the lighting fixture and allows for fluid transfer between the outer housing and inner chamber. A transparent lens at the top of the outer housing allows fluid passage through an aperture in the lens.

An underwater wet niche housing comprising an outer housing body with a side port connection capable of being connected to a fluid source. An inner chamber that, at the base, has a through connection port capable of being connected to an electrical conduit. An annular ring is located at the top of the inner chamber with internal female threads to allow a light fixture to translate into the inner chamber. At least one alignment baffle connecting the inner chamber to the outer housing. At least one pillar above the annular ring capable of translating a fastener. A transparent lens with at least one opening configured to align with at least one pillar. The lens is retained with at least one corresponding fastener translated through at least one opening, into the pillar. The inner chamber is mounted at its base to the outer housing at its inner base. The lens contains an aperture in the concentric center to allow fluid to pass through. The lens is attached with at least one fastener to at least one pillar.

Alignment baffles or support ribs allow connection of the inner chamber to at least a portion of the outer housing while allowing fluid transfer around the inner chamber. Fluid rises through the outer housing and passes through the aperture of the mounted lens to create a water structure above the lens. It is within the scope of this invention for the inner chamber to have a shorter length than the outer housing to create space for a pool light fixture to seat beneath the lens and with ample room to allow fluid transfer through the lens aperture. It is an important aspect of this current invention for the underwater wet niche housing to be configured to illuminate any water structure resulting from fluid transfer above the lens of the light fixture. It is an important aspect of the current invention for the inner and outer chambers to be concentrically placed to create a chamber for fluids to flow around the inner chamber. The inner chamber configured for retaining a lighting fixture to conserve space by concentrically locating the lighting fixture and water passage.

These and other important objects, advantages, and features of the invention will become clear as this description proceeds.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

In the following detailed description of the preferred embodiments, reference is made to the accompanying drawings, which form a part hereof, and within which are shown by way of illustrating specific embodiments by which the invention may be practiced. It is to be understood that other embodiments may be utilized and structural changes may be made without departing from the scope of the invention.

Figure 2:
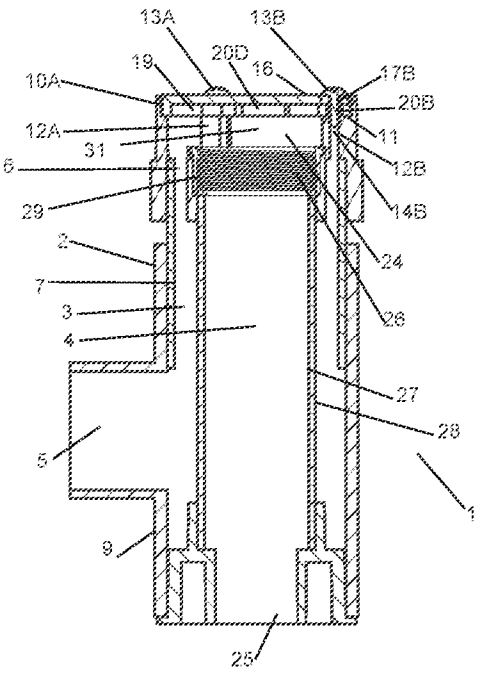
FIG. 2 is an illustration of a side cut-away view of the novel pool return fitting having a cover and a lens connected thereto in accordance with an illustrative embodiment.
Figure 3:
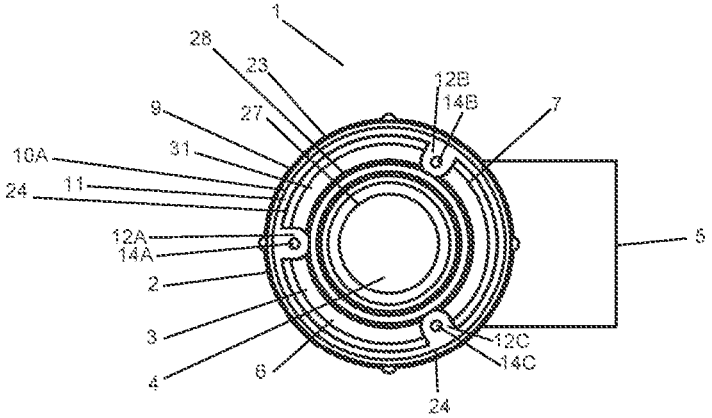
FIG. 3 is an illustration of a top view of the novel pool return fitting having a housing with an outer chamber retaining an inner chamber in accordance with an illustrative embodiment.
Figure 5:
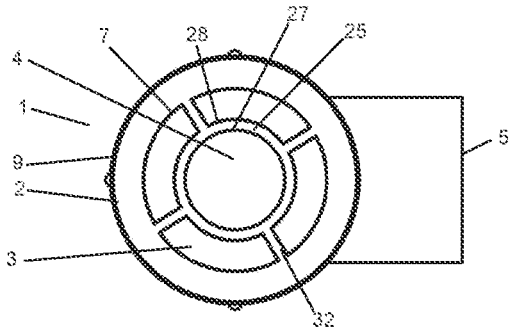
FIG. 5 is an illustration of a bottom cut-away view of the novel pool return fitting having a housing having a first chamber and a second chamber, the second chamber is retained within the first chamber by at least one support rib in accordance with an illustrative embodiment.
Figure 7:
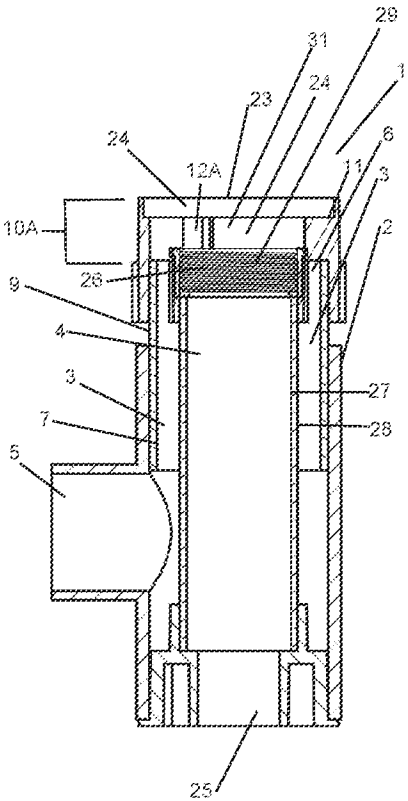
FIG. 7 is an illustration of a view side cut-away view of the novel pool return fitting having a housing in accordance with an illustrative embodiment.
Figure 16:
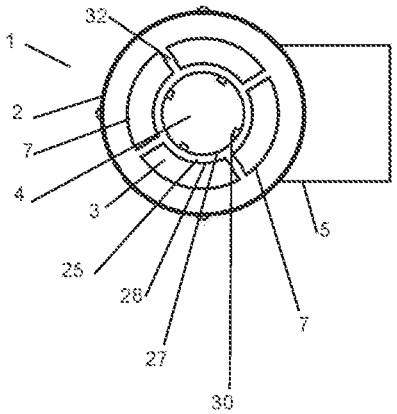
FIG. 16 is an illustration of a bottom cut-away view of an alternate embodiment of the novel pool return fitting having a housing with a second chamber having an inner wall surface with at least one protrusion extending therefrom in accordance with an illustrative embodiment; and, FIG. 17 is an illustration of a perspective view of the novel pool return fitting having a housing with a cover connected thereto with fasteners in accordance with an illustrative embodiment.

In a preferred embodiment, FIGS. 1-3 and 7 illustrate novel pool return fitting 1 having housing 2. Housing 2 has outer wall surface 9. FIGS. 2, 3, and 7 best illustrate housing 2 having first chamber 3 and second chamber 4. First chamber 3 is formed between inner wall surface 7 of housing 2 and outer wall surface 28 of second chamber 4. FIGS. 5 and 16 depict pool return fitting 1 having housing 2 with second chamber 4 being retained within first chamber 3 by at least one support rib 32. At least one support rib 32 has one end connected to first chamber 3 located opposite another end connected to second chamber 4. At least one support rib 32 connects first chamber 3 to second chamber 4. It is with the scope of this invention for a plurality of support ribs 32 to radiate outwards from outer wall surface 28 of second chamber 4 towards and connecting to inner wall surface 7 of first chamber 3.

Figure 1:
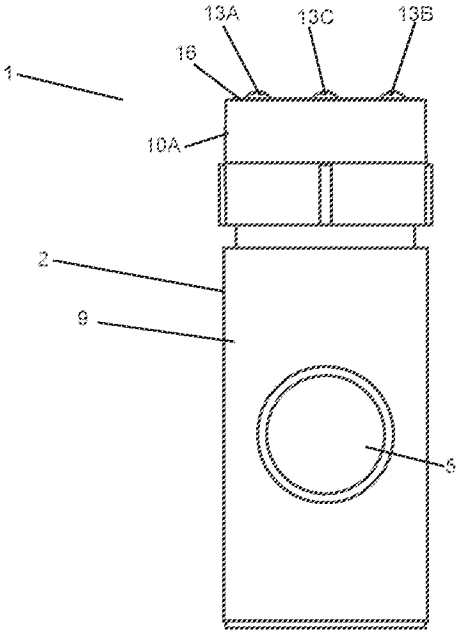
FIG. 1 is an illustration of a front view of the novel pool return fitting having a housing with a cover connected thereto with fasteners in accordance with an illustrative embodiment.

FIG. 1 shows fasteners 13A-3C connecting cover 16 to integrally formed support structure 10A of housing 2.

FIG. 2 shows removable cover 16 overlaying transparent lens 19 within integrally formed support structure 10A of housing 2. Fasteners 13A and 13B are shown. FIG. 2 best shown fastener 13B being received by opening 17B of cover 16 and being received by opening 20B of transparent lens 19 and being received by opening 14B of retaining structure 12B. Retaining structure 12A-12B is connected to inner wall surface 24, surrounding third chamber 31, of housing 2. Housing 2 has first chamber 3 and second chamber 4. Second chamber 4 is retained within first chamber 3. First chamber 3 has first pipe connection 5 configured to receive a fluid (not shown). First chamber 3 has first opening 6 bordering integrally formed support structure 10A. Second chamber 4 has second pipe connection 25. Second chamber 4 has inner wall surface 27 and outer wall surface 28. Second chamber 4 has second opening 26 configured to receive a submersible light fixture (not shown), whereby, at least a portion of the submersible light fixture is removably connected to at least a portion of inner wall surface and/or a protrusion 30 (FIG. 16) of second chamber 4. First opening 6 of first chamber 3 is configured to expel a fluid (not shown), whereby, the fluid flows from first pipe connection 5 of housing 2, and then flows between outer wall surface 28 of second chamber 4 and inner wall surface 7 of first chamber 3. Fluid (not shown) is expelled from first chamber 3 of housing 2 into third chamber 31 located within integrally formed support structure 10A, whereby, fluid flows over a lens of the submersible light fixture (not shown) retained within second chamber 4 and through at least one opening 20D of transparent lens 19 to the surrounding fluid (not shown) external to housing 2.

FIG. 3 shown end portion 23 of housing 2 having integrally formed support structure 10A with stepped portion 11 configured to retain transparent lens 19 (FIGS. 2 and 9) within integrally formed support structure 10A of housing 2. Integrally formed support structure 10A borders third chamber 31 and has at least one retaining member 12A-12C connected to inner wall surface of said housing, said at least one retaining member extending from said inner wall surface 24 of third chamber 31 of housing 2 into at least a portion of said first chamber. Second chamber 4 has inner wall surface 27 and outer wall surface 28. When a fluid enters first chamber 3, fluid flows between outer wall surface 28 of second chamber 4 and inner wall surface 7 of first chamber 3. Fluid is expelled from first chamber 3 at first opening 6 into third chamber 31.

Figure 4:
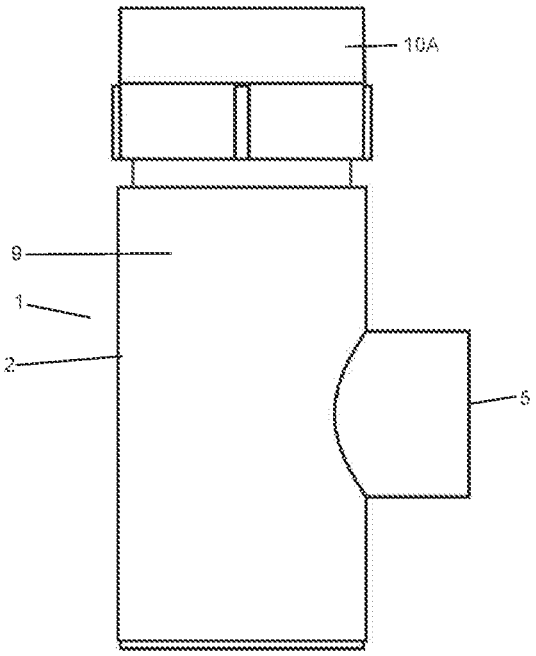
FIG. 4 is an illustration of a left side view of the novel pool return fitting having a housing in accordance with an illustrative embodiment.

FIG. 4 is an illustration of pool return fitting 1 having housing 2 with a side port being first pipe connection 5 oriented perpendicular to integrally formed structure 10A. Housing 2 has outer wall surface 9.

Figure 6:
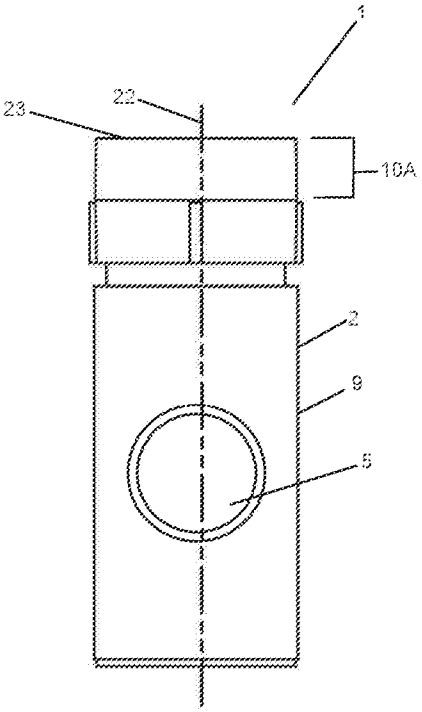
FIG. 6 is an illustration of a front view of the novel pool return fitting having a housing in accordance with an illustrative embodiment.

FIG. 6 is an illustration of pool return fitting 1 having housing 2 with outer wall surface 9. Centerline 22 shown integrally formed support structure 10A is located near the top portion of housing 2 and above side port being first pipe connection 5

Figure 8:
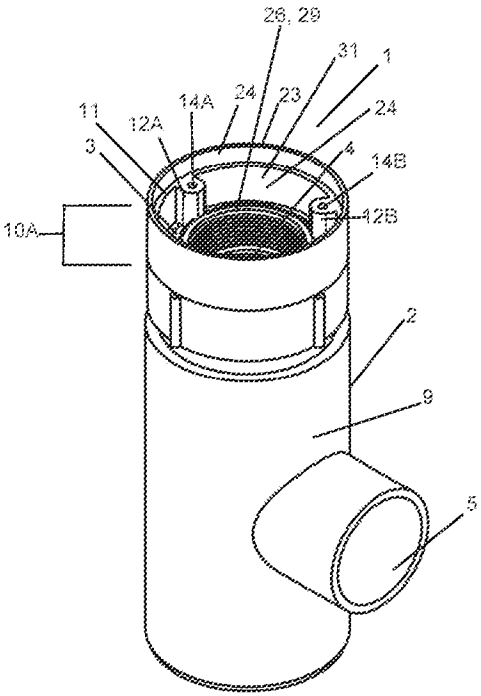
FIG. 8 is an illustration of a perspective view of the novel pool return fitting having a housing in accordance with an illustrative embodiment.

FIGS. 7-8 illustrate pool return fitting 1 having housing 2 with integrally formed support structure 10A. Integrally formed support structure 10A has stepped portion 11 connected to inner wall surface 24 of housing 2 configured to receive a transparent lens.

Figure 9:
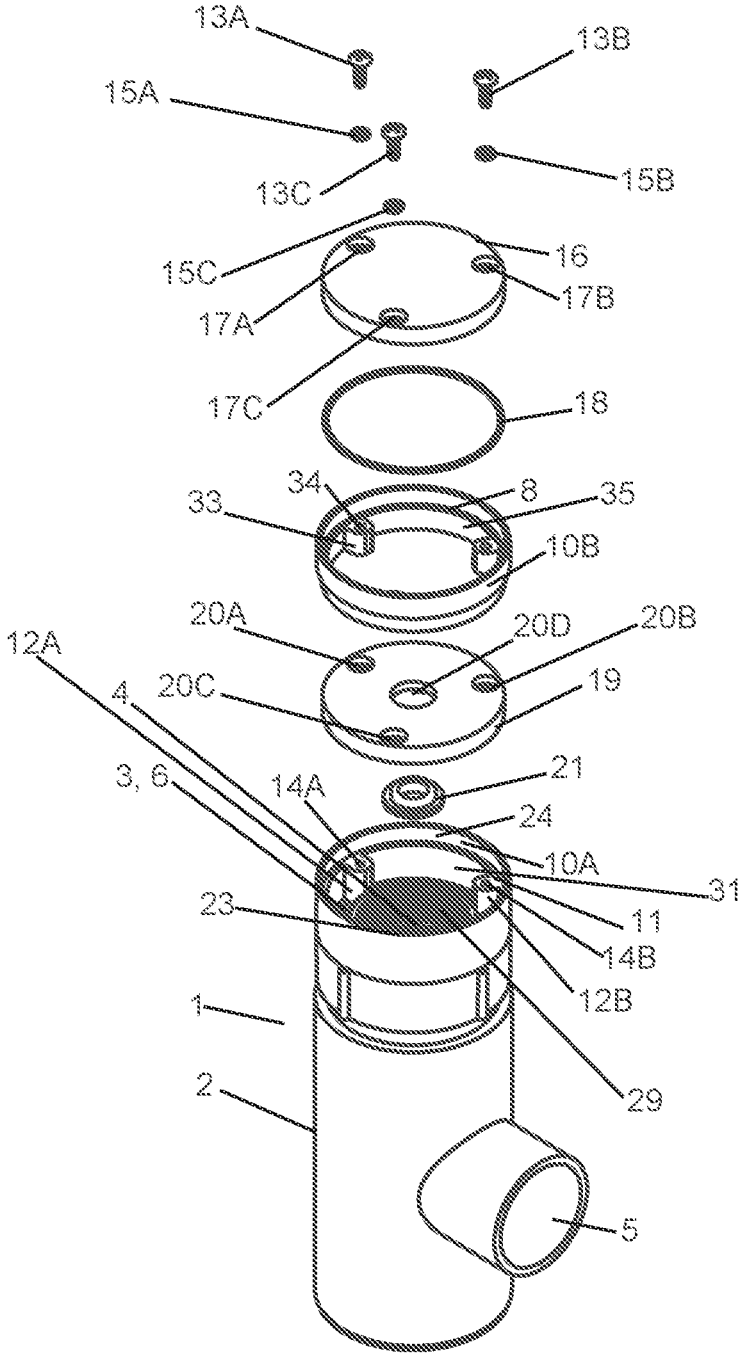
FIG. 9 is an illustration of an exploded view of the novel pool return fitting having a housing with a lens, a removable support structure, a return reducer, a cover, and a plurality of fasteners in accordance with an illustrative embodiment.
Figure 10:
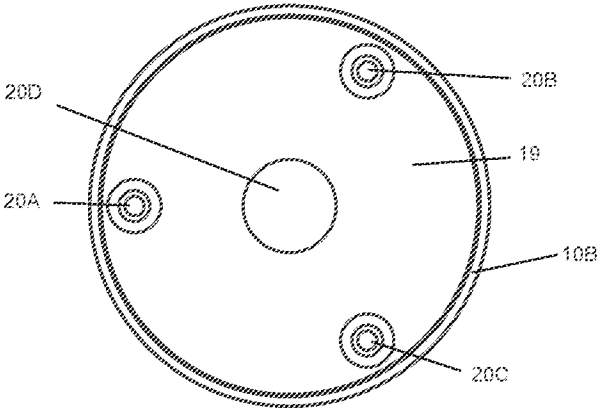
FIG. 10 is an illustration of a top view of the removable support structure retaining a lens in accordance with an illustrative embodiment.

FIG. 9 shown return reducer 21 configured to connect to opening 20D of lens 19. Housing 2 has first chamber 3 with first opening 6.

FIGS. 1-9 and 14-17 show housing 2 of pool return fitting 1 having first pipe connection 5 configured to connect to a pipe (not shown). FIGS. 2 and 7 best depict first chamber 3 having first pipe connection 5, first pipe connection 5 of first chamber 3 is configured to receive a fluid (not shown). First chamber 3 has first opening 6 bordering integrally formed support structure 10A (FIGS. 1-4, 6-9, 14-15, and 17). Referring now to FIGS. 2, 5, 7, and 16, second chamber 4 has second pipe connection 25. Second chamber 4 has inner wall surface 27 and outer wall surface 28. A channel is formed by outer wall surface 28 of second chamber 4 and inner wall surface 7 of first chamber 3. Second pipe connection 25 of second chamber 4 is configured to receive a conduit (not shown) retaining an electrical cord (not shown) of a light fixture (not shown). Second chamber 4 has second opening 26 configured to retain a submersible light fixture (not shown), whereby, at least a portion of the submersible light fixture (not shown) is removably connected to at least a portion of inner wall surface 27 of second chamber 4. Alternatively, FIG. 16 illustrates submersible light fixture (not shown) and/or its electrical cord (not shown) may be connected to at least one protrusion 30 extending from inner wall surface 27 of second chamber 4.

Figure 11:
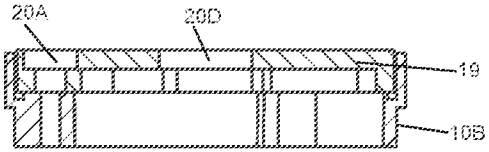
FIG. 11 is an illustration of a side cut-away view of the removable support structure retaining a lens in accordance with an illustrative embodiment.
Figure 12:
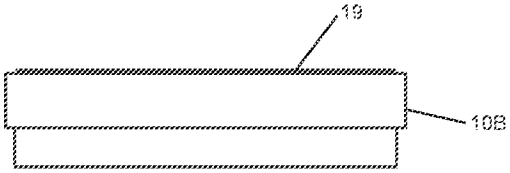
FIG. 12 is an illustration of a side view of the removable support structure retaining a lens in accordance with an illustrative embodiment.
Figure 13:
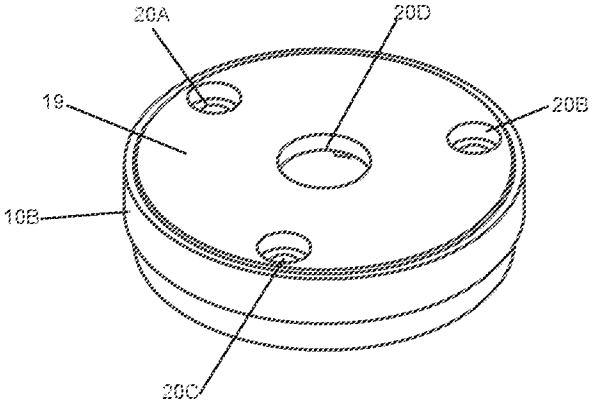
FIG. 13 is an illustration of a perspective view of the removable support structure retaining a lens in accordance with an illustrative embodiment.

FIGS. 2, and 9-13 illustrate transparent lens 19. Transparent lens 19 has at least one opening 20A-20D (FIG. 9, 10). FIGS. 2, 11 illustrate transparent lens 19 having transparent lens 20D. Transparent lens 19 is configured to overlay at least a portion of an end of first chamber 3 and an end of second chamber 4, whereby, first opening 6 of first chamber 3 is configured to expel (not shown) fluid (not shown) from first chamber 3 of housing 2 over a lens of the submersible light fixture (not shown) retained by said second chamber and through at least one opening 20D of transparent lens 19 to the surrounding fluid (not shown).

FIG. 16 illustrates an alternate embodiment in which inner wall surface 27 of second chamber 4 of housing 2 has at least one protrusion 30. At least one protrusion 30 is configured to connect to at least a portion of a submersible light fixture (not shown) and/or at least a portion of an electrical cord of the submersible light fixture within second chamber 4. It is within the scope of this invention for pool return fitting 1 to have housing 2 with inner wall surface 27 of second chamber 4 having a threaded portion 29. FIGS. 2, 7-9 show threaded portion 29 is configured to interconnect with at least a portion of a submersible light fixture (not shown) to retain the submersible light fixture within second chamber 4.

FIGS. 2-3, 7-9 best illustrate pool return fitting 1 having housing 2 with integrally formed support structure 10A having stepped portion 11. FIGS. 2 and 9 best show stepped portion 11 of integrally formed support structure 10A is configured to retain transparent lens 19 and/or cover 16 within housing 2. As best shown in FIG. 3, integrally formed support structure 10A has at least one retaining member 12A-12C connected to inner wall surface 24 of housing 2. At least one retaining member 12 extends from inner wall surface 24 of housing 2 into at least a portion of third chamber 31 (FIGS. 2-3, 7-9).

FIGS. 8-9 best illustrate pool return fitting 1 having housing 2 with transparent lens 19 having at least one bore 20A-20C (FIG. 9) configured to receive fastener 13A-13C (FIG. 9). At least one retaining member 12A-12C (FIG. 3) has an opening 14A-C (FIG. 3) configured to receive at least one fastener 13A-13C. At least one bore 20A-20C (FIG. 9) of said transparent lens 19 is aligned with at least one opening 14A-14C (FIG. 3) of at least one retaining member 14A-14C (FIG. 3). Pool return fitting 1 has housing 2 with at least one fastener 13A-13C (FIG. 9) being received by said least one bore 20A-20C of said transparent lens 19 and at least one opening 14A-14C of at least one retaining member 12A-12C, thereby, securing transparent lens 19 within integrally formed support structure 10A.

FIG. 9 best illustrates pool return fitting 1 having housing 2 with at least one sealing member 15A-15C. At least one sealing member 15A-15C is located between at least a portion of fastener 13A-13C and removable cover 16 and/or transparent lens 19. Removable cover 16 has at least one opening 17A-17C configured to receive at least one fastener 13A-13C. Integrally formed support structure 10A retains a removable support structure 10B. It is within the scope of this invention for removable support structure 10B to be capable of extending the height of housing 2. Removable support structure 10B has stepped portion 8 configured to retain sealing member 18 and/or removable cover 16. Removable support structure 10B has at least one retaining member 33 having at least one opening 34 connected to an inner wall surface 35 of removable support structure 10B.

Referring again to FIG. 9, pool return fitting 1 has housing 2 configured to receive removable cover 16. Removable cover 16 is configured to cover removable support structure 10B. Removable cover 16 has at least one bore 17A-17C configured to receive fastener 13A-13C. At least one retaining member 33 having opening 34 configured to receive at least one fastener 13A-13C fastener, thereby, securing removable cover 16 within removable support structure 10B. Sealing member 18, is an O-ring, which is located between removable cover 16 and removable support structure 10B. Removable cover 16 is configured to cover an opening on an end 23 (FIGS. 6-8) of housing 2. Removable cover 16 is configured to cover integrally formed support structure 10A.

Referring now to FIGS. 10-13, removable support structure 10B is configured to connect to housing 2 and extend the height of housing 2. Removable support structure may retain transparent lens 19. Transparent lens 19 has at least one opening 20A-20D.

Figure 14:
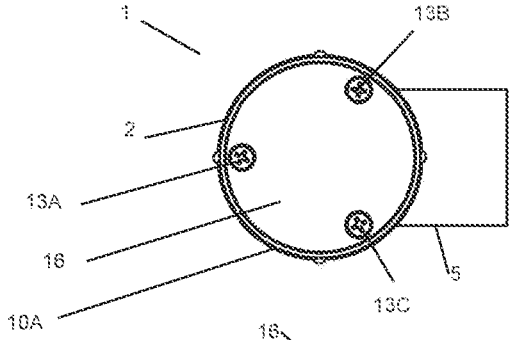
FIG. 14 is an illustration of a top view of the novel pool return fitting having a housing with a cover connected thereto with fasteners in accordance with an illustrative embodiment.
Figure 15:
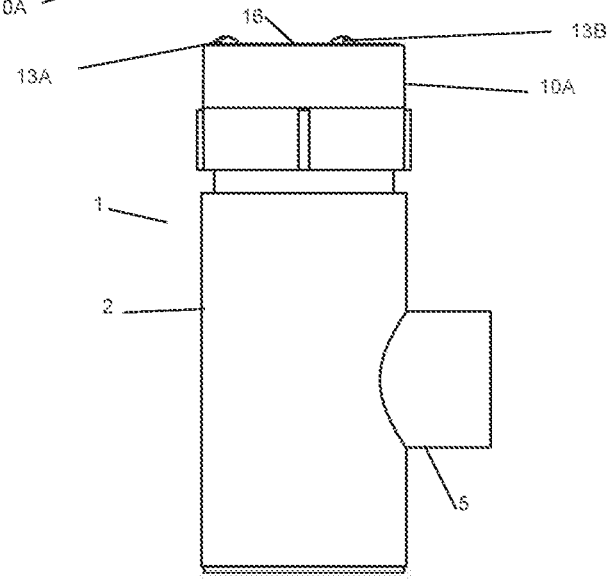
FIG. 15 is an illustration of a side view of the novel pool return fitting having a housing with a cover connected thereto with fasteners in accordance with an illustrative embodiment.
Figure 17:
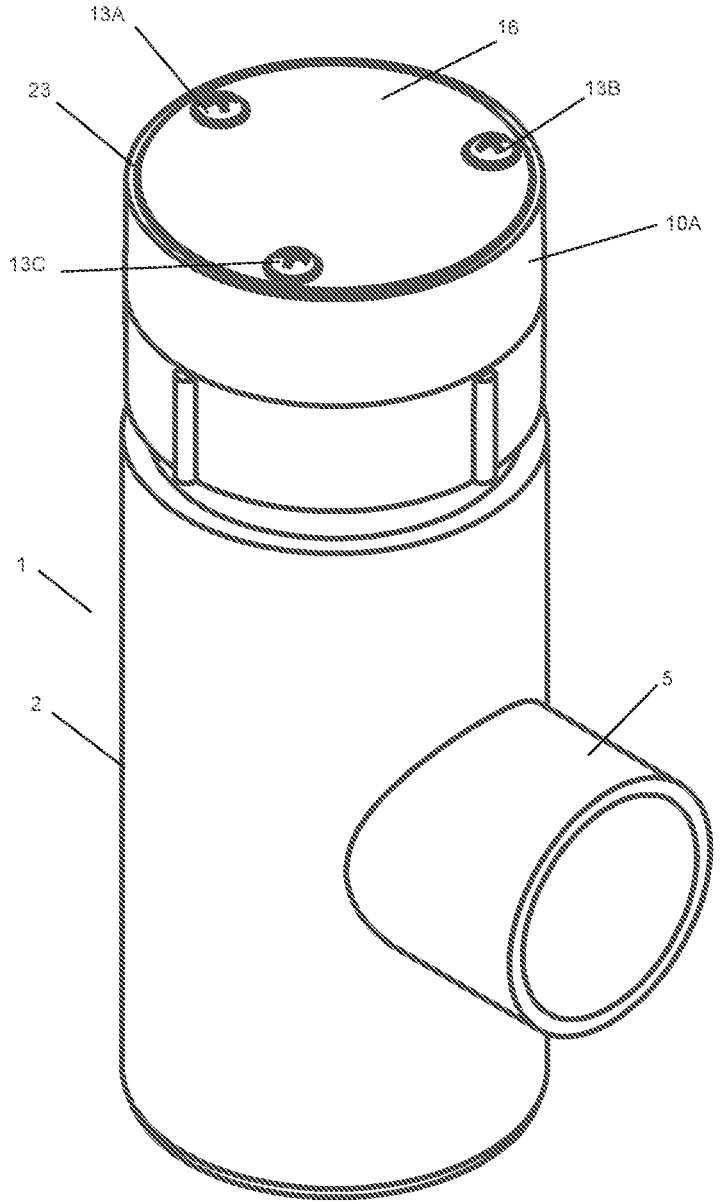

FIGS. 14-15, 17 are an illustrative embodiment of pool return fitting 1 having housing 2 with integrally formed support structure 10A retaining removable cover 16. Fasteners 13A-13C retain removable cover 16 within integrally formed support structure 10A. First pipe connection 5 extends from a sidewall of housing 2. FIG. 17 shows removable cover 16 is connected to end portion 23 of housing 2.

The described embodiments are illustrative of the invention and are not exhaustive thereof.

The invention accordingly comprises the features of construction, combination of elements, and arrangement of parts that will be exemplified in the description set fourth hereinafter and the scope of the invention will be indicated in the claims.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the description is intended to cover all of the generic and specific features of the invention herein described, and all statements of the scope of the invention that, as a matter of language, might be said to fall therebetween.

Now that the invention has been described,

The invention claimed is:

1. A pool return fitting, comprising:

a housing having a first chamber and a second chamber, said second chamber is retained within said first chamber by at least one support rib;

said first chamber having a first pipe connection, said first pipe connection of said first chamber is configured to receive a fluid, said first chamber having a first opening bordering an integrally formed support structure, said integrally formed structure having a third chamber;

said second chamber having a second pipe connection, said second chamber having an inner wall surface and an outer wall surface, said second pipe connection of said second chamber is configured to receive a conduit retaining an electrical cord of a submersible light fixture, said second chamber having a second opening, said second opening is configured to receive said submersible light fixture; and, a transparent lens, said transparent lens having at least one opening, said transparent lens is configured to connect to said integrally formed support structure;

a channel, said channel formed by said outer wall surface of said second chamber and said inner wall surface of said first chamber, whereby, said fluid received by said first pipe connection flows through said channel of said first chamber and is expelled from said first chamber into said third chamber, whereby, said fluid is configured to flow over a lens of said submersible light fixture retained by said second chamber and through said at least one opening of said transparent lens to the surrounding fluid external of said housing.

2. The pool return fitting of claim 1, further comprising:

said inner wall surface of said second chamber having at least one protrusion, said at least one protrusion is configured to connect to at least a portion of said submersible light fixture, whereby, said submersible light fixture is retained in said second chamber.

3. The pool return fitting of claim 1, further comprising:

said inner wall surface of said second chamber having a threaded portion, said threaded portion is configured to interconnect with at least a portion of said submersible light fixture, thereby, retaining said submersible light fixture within said second chamber.

4. The pool return fitting of claim 1, further comprising:

said integrally formed support structure having a stepped portion configured to retain said transparent lens within said housing, said integrally formed support structure having at least one retaining member connected to an inner wall surface of said housing, said at least one retaining member extending from said inner wall surface of said housing into at least a portion of said third chamber.

5. The pool return fitting of claim 4, further comprising:

said transparent lens having at least one bore configured to receive a fastener, said at least one retaining member having an opening configured to receive said fastener, said at least one bore of said transparent lens is aligned with said opening of said at least one retaining member when said fastener is received by said least one bore of said transparent lens and said opening of said at least one retaining member, thereby, securing said transparent lens within said integrally formed support structure.

6. The pool return fitting of claim 1, further comprising:

a sealing member, said sealing member is located between at least a portion of said fastener and said transparent lens.

7. The pool return fitting of claim 5, further comprising:

said integrally formed support structure retains a removable support structure, said removable support structure having a stepped portion configured to retain a removable cover, said removable support structure having at least one retaining member connected to an inner wall surface of said removable support structure.

8. The pool return fitting of claim 7, further comprising:

a removable cover, said removable cover is configured to cover said removable support structure, said removable cover having at least one bore configured to receive a fastener, said at least one retaining member of said removable support structure and said integrally formed support structure having an opening configured to receive said fastener, thereby, securing said removable cover within said removable support structure.

9. The pool return fitting of claim 8, further comprising:

a sealing member, said sealing member is located between at least a portion of said fastener and said removable cover.

10. The pool return fitting of claim 8, further comprising:

a sealing member, said sealing member is located between said removable cover and said removable support structure.

11. The pool return fitting of claim 1, further comprising:

a removable cover, said removable cover is configured to cover an opening on an end of said housing and/or said integrally formed support structure.

12. The pool return fitting of claim 1, further comprising:

said second opening of said second chamber is configured to receive a submersible light fixture; whereby, at least a portion of said submersible light fixture is removably connected to at least a portion of said inner wall surface of said second chamber.

13. A pool return fitting, comprising:

a housing having a first chamber and a second chamber, said second chamber is retained within said first chamber by at least one support rib, said support rib having one portion connected to said first chamber and another portion traversing to said second chamber and being connected to said second chamber;

an integrally formed support structure, said integrally formed support structure bordering a third chamber, said first chamber having a first pipe connection, said first pipe connection of said first chamber is configured to receive a fluid, said first chamber having a first opening bordering said integrally formed support structure;

said second chamber having a second pipe connection, said second chamber having an inner wall surface and an outer wall surface, said second pipe connection of said second chamber is configured to connect to a conduit retaining a fiber optic cable, said second chamber having a second opening, said second opening of said second chamber is configured to retain a submersible light fixture, whereby, at least a portion of said submersible light fixture is removably connected to said second chamber;

a transparent lens, said transparent lens having at least one opening, said transparent lens is configured to overlay said integrally formed support structure;

said first opening of said first chamber is configured to expel said fluid, whereby, said fluid flowing from said first pipe connection of said housing, and then flowing between said outer wall surface of said second chamber and inner wall surface of said first chamber, and then said fluid is expelled from said first chamber of said housing into said third chamber of said integrally formed support structure, whereby, said fluid flows over a lens of said submersible light fixture and through said at least one opening of said transparent lens to the surrounding fluid external to said housing.

14. The pool return fitting of claim 13, further comprising:

said inner wall surface of said second chamber having at least one protrusion, said at least one protrusion is configured to connect to at least a portion of said submersible light fixture retained in said second chamber.

15. The pool return fitting of claim 13, further comprising:

said inner wall surface of said second chamber having a threaded portion, said threaded portion is configured to interconnect with at least a portion of said submersible light fixture.

16. The pool return fitting of claim 13, further comprising:

said integrally formed support structure having a stepped portion configured to retain said transparent lens within said housing, said integrally formed support structure having at least one retaining member connected to an inner wall surface of said housing, said at least one retaining member extending from said inner wall surface of said third chamber of said housing.

17. The pool return fitting of claim 16, further comprising:

said transparent lens having at least one bore configured to receive a fastener, said at least one retaining member having an opening configured to receive said fastener, said at least one bore of said transparent lens is aligned with said opening of said at least one retaining member when said fastener is received by said least one bore of said transparent lens and said opening of said at least one retaining member, thereby, securing said transparent lens within said integrally formed support structure.

18. The pool return fitting of claim 13, further comprising:

a sealing member, said sealing member is located between at least a portion of said fastener and said transparent lens.

19. The pool return fitting of claim 17, further comprising:

said integrally formed support structure retains a removable support structure, said removable support structure having a stepped portion configured to retain a removable cover, said removable support structure having at least one retaining member connected to an inner wall surface of said removable support structure.

20. The pool return fitting of claim 19, further comprising:

a removable cover, said removable cover is configured to cover said removable support structure, said removable cover having at least one bore configured to receive a fastener, said at least one retaining member having an opening configured to receive said fastener, said at least one bore of said removable cover is aligned with said opening of said at least one retaining member when said fastener is received by said least one bore of said removable cover and said opening of said at least one retaining member, thereby, securing said removable cover within said removable support structure.

* * * * *